US005400920A

United States Patent [19]

Barnhart

[11] Patent Number: 5,400,920

[45] Date of Patent: Mar. 28, 1995

[54] ONE-TIME FILL AEROSOL VALVE

[75] Inventor: James B. Barnhart, Afton, Minn.

[73] Assignee: Minnesota Mining and Manufacturing Company, St. Paul, Minn.

[21] Appl. No.: 99,183

[22] Filed: Jul. 29, 1993

[51] Int. Cl.[6] ..... B65D 49/00

[52] U.S. Cl. ..... 222/1; 222/147; 222/402.13; 222/402.20

[58] Field of Search ..... 222/147, 1, 402.10, 222/402.13, 402.24, 402.20; 215/19; 141/3, 20

[56] References Cited

U.S. PATENT DOCUMENTS

| | | | |
|---|---|---|---|
| 2,747,775 | 5/1956 | Pritchard | 222/400.7 |
| 3,499,584 | 3/1970 | Warren | 222/402.2 |
| 3,591,059 | 7/1971 | Stearns | 222/402.2 |
| 3,704,813 | 12/1972 | Devol | 137/315 X |
| 3,985,332 | 10/1976 | Walker | 222/147 X |
| 4,220,265 | 9/1980 | Shay | 141/20 X |
| 4,543,980 | 10/1985 | Van der Sanden | 137/315 |
| 4,573,611 | 3/1986 | O'Connor | 222/147 |
| 4,597,512 | 7/1986 | Wilmot | 222/402.2 |
| 4,660,744 | 4/1987 | Casaszar | 222/147 |
| 4,819,834 | 4/1989 | Thiel | 222/355 |
| 5,018,552 | 5/1991 | Politi et al. | 222/147 X |
| 5,131,625 | 7/1992 | Hacker et al. | 251/149.6 |
| 5,305,925 | 4/1994 | Vogel | 222/402.1 X |

*Primary Examiner*—Andres Kashnikow
*Assistant Examiner*—Anthoula Pomrening
*Attorney, Agent, or Firm*—Gary L. Griswold; Walter N. Kirn; Douglas E. Reedich

[57] ABSTRACT

A valve for delivering a metered dose of a medicinal aerosol formulation. The valve has a filling state, a filled state, a metering state, and a dispensing state. A metering chamber is formed when the device is taken from the filled state to the metering state. Once the valve has been placed in the filled state it can no longer be placed in the filling state.

4 Claims, 12 Drawing Sheets

ONE-TIME FILL AEROSOL VALVE

BACKGROUND OF THE INVENTION

1. Field of the Invention

This invention relates to valves for delivering metered doses of aerosol formulations, and to such valves having a positive fill metering chamber. In another aspect this invention relates to methods of filling an aerosol canister. In yet another aspect this invention relates to methods of delivering a metered dose of an aerosol formulation.

2. Description of the Related Art

Conventional chlorofluorocarbon based medicinal aerosol formulations generally contain a relatively nonvolatile component (e.g., trichlorofluoromethane, propellant 11), a surfactant, a drug, and a volatile propellant system (e.g., a combination of dichlorodifluoromethane, propellant 12, and dichlorotetrafluoroethane, propellant 114). Likewise certain formulations based on alternative non-CFC propellants such as 1,1,1,2-tetrafluoroethane or 1,1,1,2,3,3,3-heptafluoroethane can contain nonvolatile components such as surfactants and cosolvents (e.g., an alcohol such as ethanol). Such formulations can be filled into individual aerosol canisters by one of two conventional methods: pressure filling or cold filling. Cold filling generally involves the preparation of a mixture of the nonvolatile components at room temperature and ambient pressure to form a concentrate. This concentrate is then cooled to a temperature at which the remaining components are liquid at ambient pressure. The volatile components are also cooled and added to the concentrate to afford a liquid formulation that is filled into individual canisters, also at reduced temperature. A valve is crimped into place on the canister and the finished product is allowed to warm to ambient temperature.

Pressure filling is generally a two step process that involves the same preparation of a concentrate containing nonvolatile components. An appropriate amount of the concentrate is metered into an individual canister at ambient temperature and pressure. A valve is then crimped into place. The volatile components are then added to the canister via the valve under pressure sufficient to liquify the volatile components.

There are several deficiencies in conventional pressure filling methods. For one, conventional pressure fill valves generally involve a gasket or similar seal past which the propellant is forced under pressure great enough to displace or deform the gasket or seal. The gasket or seal functions as a one-way valve. Once a device involving such a gasket or seal is filled, the pressure of the propellant on the gasket or seal is sufficient to prevent release of the propellant. However, the fact that the gasket or seal must be displaced or deformed results in the formulation being passed through a small passageway, producing relatively high backpressures which in turn will limit the speed at which filling can be carried out. Further, since backpressures are relatively high it is problematic to fill relatively viscous formulations. Hence the need to fill certain formulations in the two stage manner described above in order to avoid forcing viscous materials through a small passageway. A resultant disadvantage in conventional pressure filling lies in the fact that it involves two processing steps.

Certain metered dose valves for use in connection with pharmaceutical aerosol formulations have deficiencies relating to the fact that the metering tank must be refilled with formulation before the valve stem is depressed to discharge a dose. In some instances the metering tank holds a dose of formulation for an extended period of time before the dose is discharged. These deficiencies have been addressed in U.S. Pat. No. 4,819,834 (Thiel) by a valve design in which a metering chamber is simultaneously created and filled upon depressing of the valve stem. Such valves are referred to as "positive fill valves". Such valves, however, still require that a seal or gasket be displaced upon filing.

It can be seen that a valve that overcomes the several disadvantages mentioned above in connection with pressure filling while maintaining the known advantages of a positive fill metering chamber would be of significant utility.

SUMMARY OF THE INVENTION

This invention provides a device for delivering a metered dose of an aerosol formulation, comprising:

a valve ferrule; a formulation chamber; and a valve stem mounted within the valve ferrule and having a first portion having a first diameter and a second portion having greater diameter than the first diameter, the valve stem being movable between a first filling state, a second filled state, a third metering state, and a fourth dispensing state;

means for establishing open communication between the exterior of the device and the formulation chamber when the device is in the first filling state; means for preventing return of the device to the first filling state from the second filled state; means for forming a metering chamber having a predetermined volume when the device is in the third metering state; means for supplying formulation to a metering chamber from the formulation chamber as such chamber is being formed; and means for establishing open communication via the valve stem between the metering chamber and the exterior of the device when the device is in the fourth dispensing state.

In another aspect this invention provides a device for delivering a metered dose of an aerosol formulation, comprising:

a valve ferrule; a metering chamber; a formulation chamber; and a valve stem mounted within the valve ferrule and having a first portion having a first diameter and a second portion having greater diameter than the first diameter, the valve stem having walls defining a valve stem orifice and being movable between a first filling state, a second filled state, a third metering state, and a fourth dispensing state;

wherein in the first filling state at least part of the first portion of the valve stem is internal to the valve ferrule, and the formulation chamber and the exterior of the device are in open communication, in the second filled state the first portion of the valve stem is external to the valve ferrule and the second portion of the valve stem is internal to the valve ferrule and occupies substantially the entire metering chamber, in the third metering state at least part of the first portion of the valve stem is internal to the valve ferrule forming a metering chamber defined by the valve stem and the valve ferrule, and the metering chamber communicates with the formulation chamber, in the fourth dispensing state at least part of the first portion of the valve stem is internal to the valve ferrule and the metering chamber is sealed from the formulation chamber and communicates with the exterior of the device via the valve stem orifice, the device further comprising means for preventing return of the device to the first filling state once it has been placed in the second filled state.

The device of the invention provides open communication between the exterior of the device and the formulation chamber when the device is in the filling position without an intervening seal or gasket that functions as a one-way valve and must be deformed or displaced by the formulation in order to allow filling of the device. This allows higher filling rates and avoids the above discussed problems associated with the prior art devices that involve deformation or displacement of gaskets or seals in the filling process. Such open communication, however, does not allow the escape of formulation components from the filled device because the device, once filled, cannot be placed again in the filling state. The open communication in the filling state also allows single-stage filling of suspensions and relatively viscous liquids (such as those containing non-volatile premixes of aerosol formulations) that must be filled in a two-stage process through valves involving deformed or displaced gaskets.

DETAILED DESCRIPTION OF PREFERRED EMBODIMENTS

Figure 1:
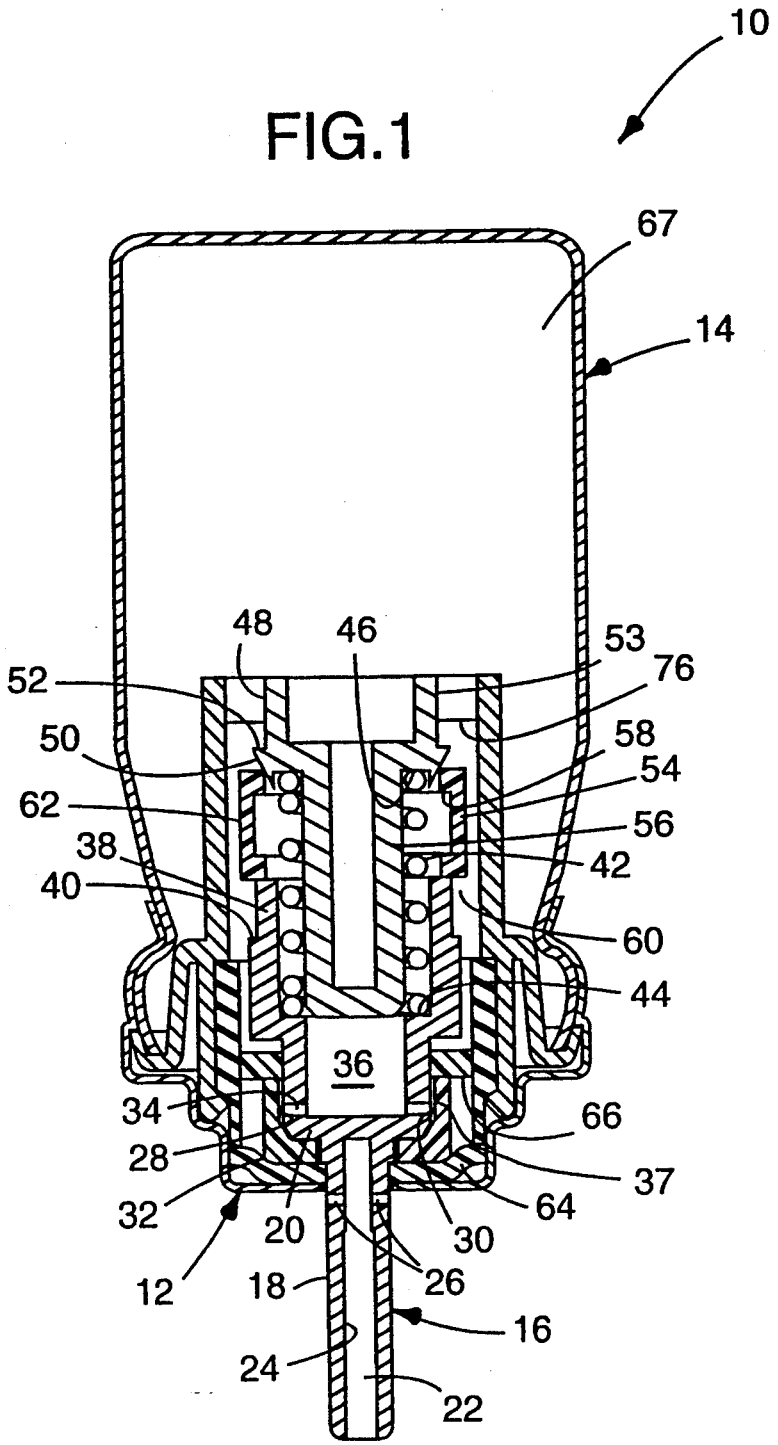
FIG. 1 is a cross sectional view of one embodiment of the invention prior to filling.

Referring to the Drawing, FIG. 1 shows device 10 of the invention comprising valve ferrule 12 crimped onto aerosol vial body 14. Ferrule 12 houses certain of the components of the device, such as seals, gaskets, springs, and the like, and the several means described in detail below. Valve stem 16 is also housed by the valve ferrule. The valve stem has a first portion 18 generally exterior to the ferrule and a second portion 20 generally interior to the ferrule. First portion 18 has a diameter that is less than the diameter of second portion 20. Valve stem 16 also has discharge channel 22 defined by walls 24 of the first portion of the valve stem, and exit orifice 26 which communicates with discharge channel 22 of the valve stem. Exit orifice 26 is exterior to valve ferrule 12 when the device is in the state illustrated in FIG. 1 (prior to filling) and also when the device is in the filled state described in detail below.

Second portion 20 of the valve stem comprises walls 28 that are of substantially the same configuration as adjacent walls 30 of assembly 32. Second portion 20 also has a passageway 34 that communicates with interior chamber 36. There exists an annular gap 37 between assembly 32 and the walls of the second portion of the valve stem. Gap 37 as shown is exaggerated in size for the purpose of illustration, but generally is of a size sufficient to allow the ingress of aerosol formulation. The second portion of the valve stem also comprises boss 38 and stop 40.

Device 10 further comprises spring 42 which biases valve stem 16 toward an extended closed position as illustrated in FIG. 1. Spring 42 engages the valve stem at shoulder 44 and it engages the valve ferrule at channel 46 of expander 48. Expander 48 comprises beveled edge 50 having an outside diameter that increases progressively along the axis of the expander in the direction away from channel 46. Beveled edge 50 terminates at catch 52 and the diameter of the expander decreases abruptly to form region 53 of decreased diameter.

Expansion ring 54 surrounds core 56 of the valve stem and is intermediate boss 38 and expander 48. Expansion ring 54 comprises hook 58 generally complementary and proximal to catch 52, ledge 60 proximal to boss 38, and walls 62 spanning hook 58 and ledge 60. Hook 58 and ledge 60 extend radially inward from walls 62. As will be apparent from the description to follow, the expansion ring functions as a latch spring that, in combination with expander 48, boss 38, and stop 40, allows the device of the invention to attain the several salient states referred to herein and illustrated in the Drawing.

Figure 2:
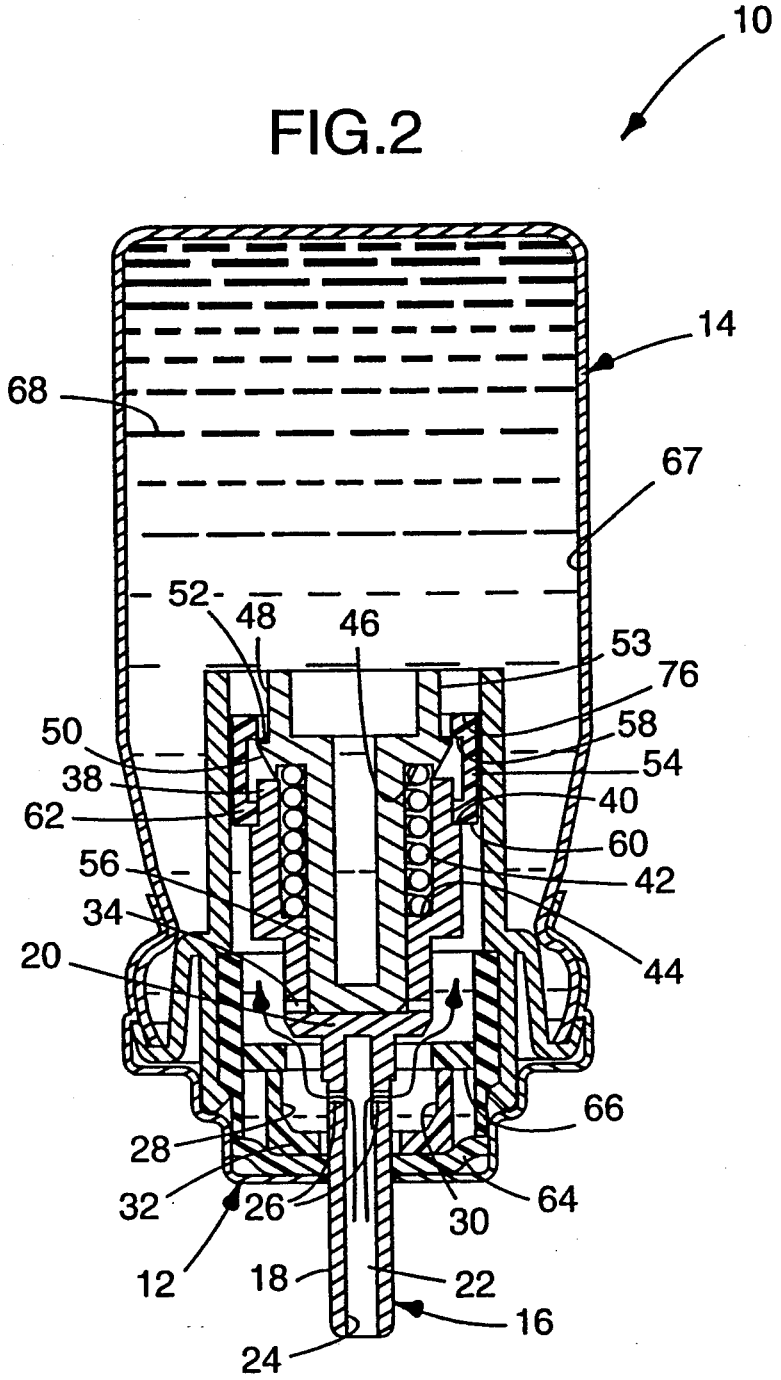
FIG. 2 is a cross sectional view of the embodiment of FIG. 1 in the filling state.

Referring now to FIG. 2, a device of the invention in the filling state is illustrated. Valve stem 16 is fully displaced inward relative to the valve ferrule. Stop 40 of the valve stem is engaged with ledge 60 of expansion ring 54, which has been displaced by boss 38 along beveled edge 50. Displacement along the beveled edge causes the expansion ring to expand to a diameter sufficient to allow boss 38 to slip inside the expansion ring. In some instances the beveled edge of the expander might not expand the opposite end of the expansion ring sufficiently to allow boss 38 to slip inside the expansion ring upon displacement of the valve stem. Therefore in the manufacture of a device as illustrated in FIG. 1, it is preferred that the valve stem and the expansion ring be preassembled such that boss 38 is inserted at least partly into the expansion ring. Ledge 60, expansion ring 54, boss 38, and core 56 are dimensioned such that displacement of the valve stem allows hook 58 to be displaced beyond beveled edge 50 to region 53 of decreased diameter.

Diaphragm 64 is in sealing engagement with first portion 18 of the valve stem. Orifice 26 is internal to valve ferrule 12, allowing open communication between the interior and the exterior of the valve ferrule. Further, second portion 20 of the valve stem is displaced beyond. annular seal 66, establishing open communication to formulation chamber 67. Such open communication in principle would allow a formulation to pass in either direction between the formulation chamber and the exterior of the device. Moreover, it is established by merely depressing the valve stem and does not require pressurization of the device during filling, e.g., to operate a one-way valve involving a displaceable or deformable seal or gasket. Formulation 68 can be filled into the device through the valve stem using conventional pressure filling equipment.

Figure 3:
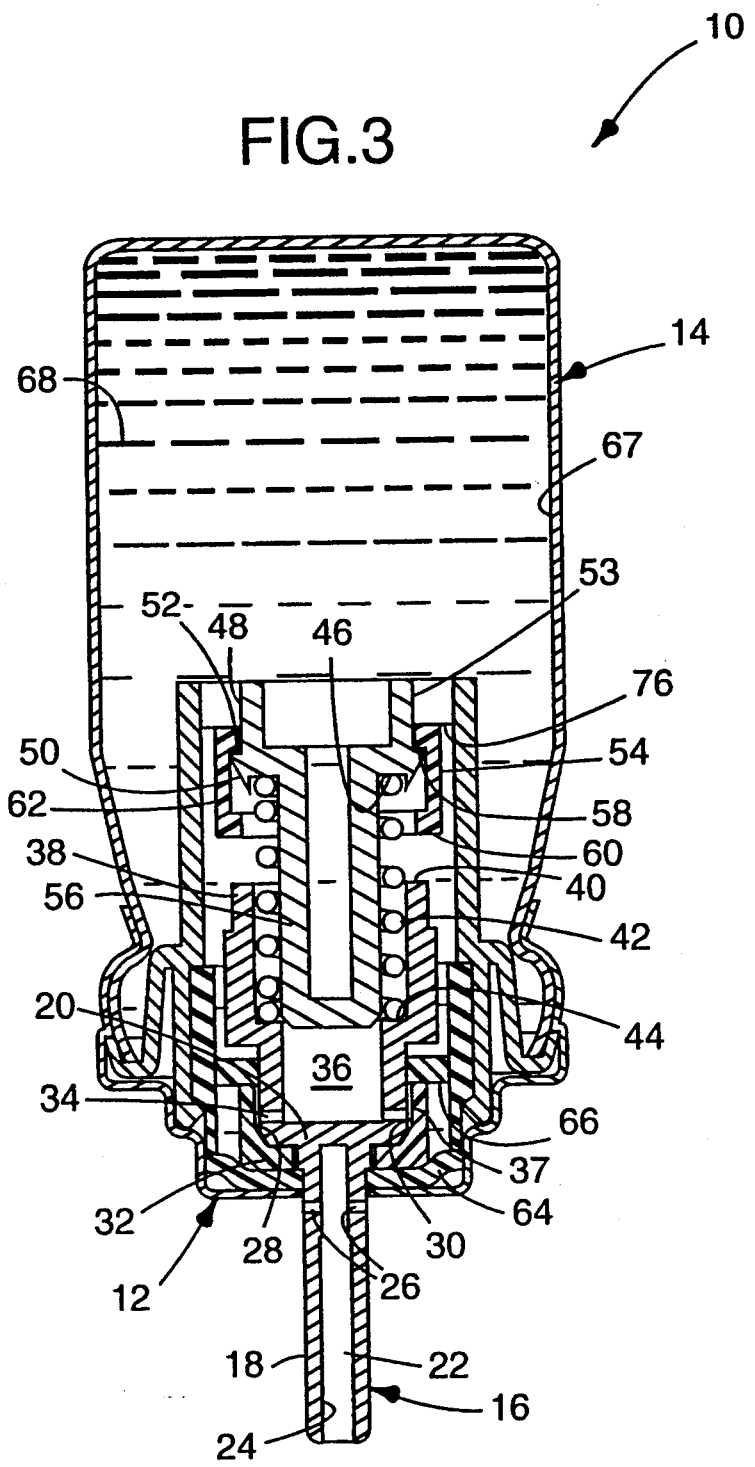
FIG. 3 is a cross sectional view of the embodiment of FIG. 1 in the filled state.

FIG. 3 shows device 10 in the filled state. Spring 42 biases valve stem 16 to an extended closed position wherein orifice 26 is external to valve ferrule 12. Second portion 20 of the valve stem and assembly 32 are disposed as described above, closely complementary with gap 37 therebetween. Boss 38 has been extracted under the bias of spring 42 from the interior of expansion ring 54 and hook 58 is engaged with catch 52, holding expansion ring 54 in place. As will be described below, the position and diameter of the expansion ring prevent the device from being placed again in the filling state.

Figure 4:
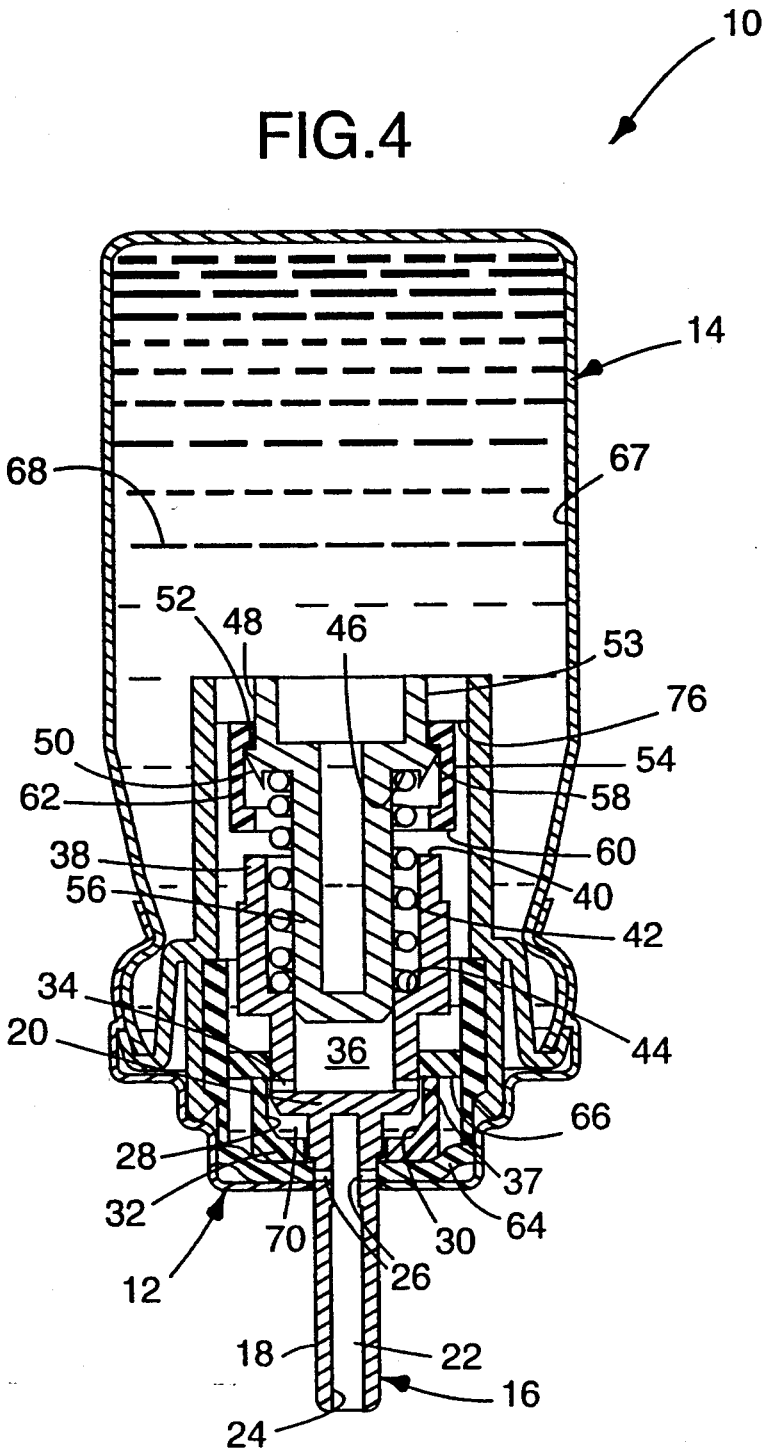
FIG. 4 is a cross sectional view of the embodiment of FIG. 1 in the metering state.

FIG. 4 shows device 10 in the metering state. Valve stem 16 is partially depressed against the bias of spring 42. A part of first portion 18 is internal to the valve ferrule and a corresponding part of second portion 20 of the valve stem is displaced from assembly 32. Metering chamber 70 is being formed by displacement of the second portion by the first portion of lesser diameter. Passageway 34 allows communication between interior chamber 36 and the metering chamber. Interior chamber 36 in turn communicates with formulation chamber 67. As the metering chamber is formed it fills via gap 37 with formulation.

Figure 5:
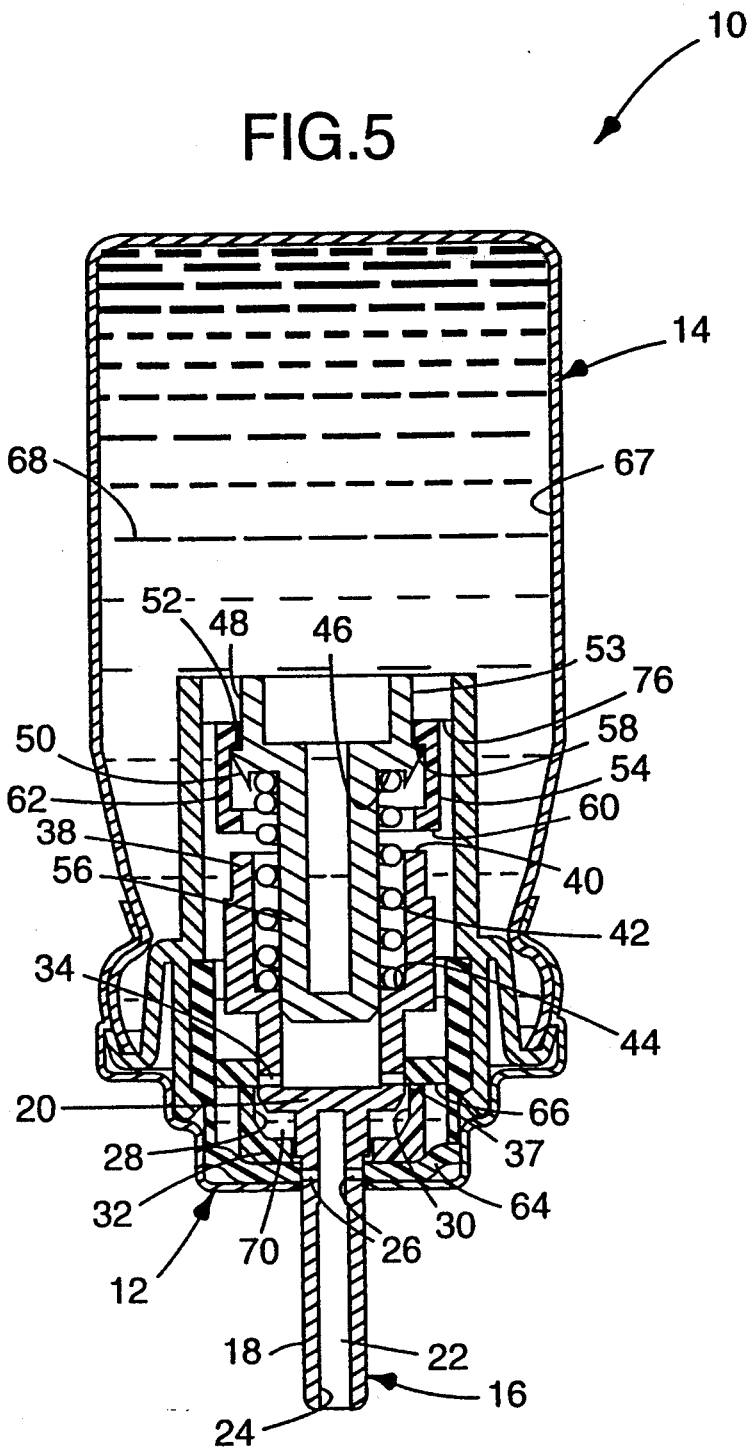
FIG. 5 is a cross sectional view of the embodiment of FIG. 1 wherein a full metered dose is isolated within the metering chamber.

FIG. 5 shows device 10 in the state wherein a full metered dose is isolated within metering chamber 70. Valve stem 16 is partially depressed against the bias of spring 42 such that passageway 34 is in sealing engagement with annular seal 66, thereby terminating the communication between the metering chamber and the formulation chamber. Orifice 26 is not in communication with the metering chamber and diaphragm 64 remains in sealing engagement with valve stem 16.

Figure 6:
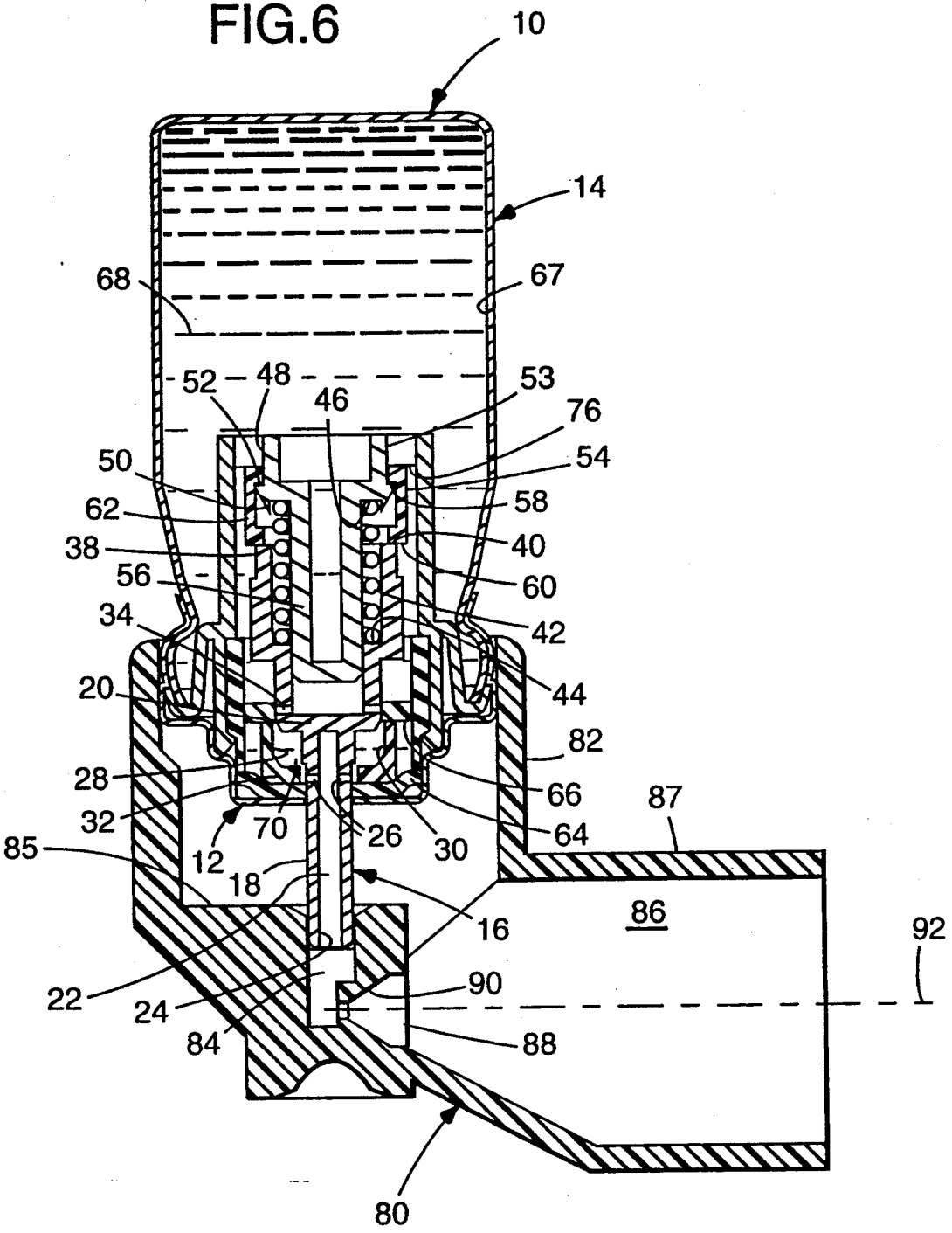
FIG. 6 is a cross sectional view of the embodiment of FIG. 1 in the dispensing state in combination with an actuator.

FIG. 6 shows device 10 in the dispensing state and in combination with an actuator. Valve stem 16 is fully depressed against the bias of spring 42 to the point where boss 38 engages ledge 60 of expansion ring 54. The valve stem cannot be further depressed, for the expansion ring is fixed in position by engagement with catch 52 and base 76. Annular seal 66 isolates the metering chamber from internal chamber 36 and formulation chamber 67. Orifice 26, however, is internal to valve ferrule 12 and communicates with metering chamber 70, allowing the contents of the metering chamber to escape via the orifice and discharge channel 22.

Actuator 80 comprises housing 82 adapted to receive and support device 10. Valve stem 16 is friction fit into bore 84 in nozzle block 85. Bore 84 communicates between valve stem 16 and inhalation chamber 86 in the mouthpiece 87 of the actuator. Bore 84 has an exit orifice 88 comprising frustoconical portion 90. The metered dose is discharged from metering chamber 70, through valve stem 16, into bore 84, and out into inhalation chamber 86 generally along axis 92 of exit orifice 88.

While device 10 is illustrated in combination with relatively simple press and breathe actuator 80, it will be readily appreciated that a device of the invention can be used in combination with any actuator designed to receive a valve stem, including but not limited to breath actuated devices such as those disclosed in U.S. Pat. No. 4,664,107 (Wass).

Figure 7:
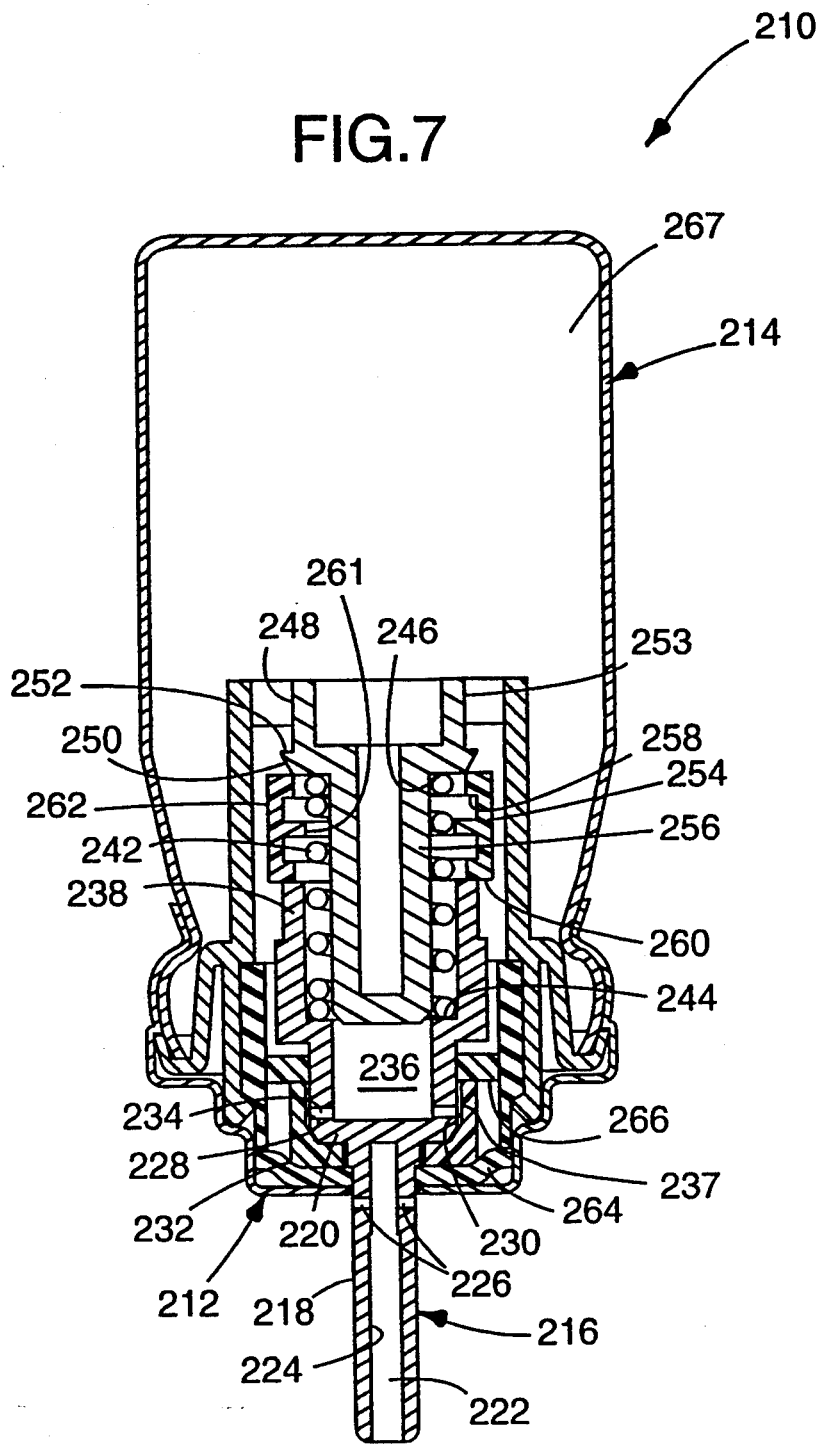
FIGS. 7–9 are cross sectional views of an alternative embodiment of the invention.

Referring to another embodiment shown in the Drawing, FIG. 7 shows device 210 of the invention comprising valve ferrule 212 crimped onto aerosol vial body 214. Ferrule 212 houses certain of the components of the device, such as seals, gaskets, springs, and the like, and the several means described in detail below. Valve stem 216 is also housed by the valve ferrule. The valve stem has a first portion 218 generally exterior to the ferrule and a second portion 220 generally interior to the ferrule. First portion 218 has a diameter that is less than the diameter of second portion 220. Valve stem 216 also has discharge channel 222 defined by walls 224 of the first portion of the valve stem, and exit orifice 226 which communicates with discharge channel 222 of the valve stem. Exit orifice 226 is exterior to valve ferrule 212 when the device is in the state illustrated in FIG. 7 (prior to filling) and also when the device is in the filled state described in detail below.

Second portion 220 of the valve stem comprises walls 228 that are of substantially the same configuration as adjacent walls 230 of assembly 232. Second portion 220 also has a passageway 234 that communicates with interior chamber 236. There exists an annular gap 237 between assembly 232 and the walls of the second portion of the valve stem. Gap 237 is of a size sufficient to allow the ingress of aerosol formulation. The second portion of the valve stem also comprises boss 238.

Device 210 further comprises spring 242 which biases valve stem 216 toward an extended closed position. Spring 242 engages the valve stem at shoulder 244 and it engages the valve ferrule at channel 246 of expander 248. Expander 248 comprises beveled edge 250 having an outside diameter that increases progressively along the axis of the expander in the direction away from channel 246. Beveled edge 250 terminates at catch 252 and the diameter of the expander decreases abruptly to form region 253 of decreased diameter.

Expansion ring 254 surrounds core 256 of the valve stem and is intermediate boss 238 and expander 248. Expansion ring 254 comprises hook 258 generally complementary and proximal to catch 252, ledge 260 proximal to boss 238, and walls 262 spanning hook 258 and ledge 260. Expansion ring 254 also comprises stop 261 between the hook and the ledge. Hook 258, ledge 260, and stop 261 extend radially inward from walls 262. As will be apparent from the description to follow, the expansion ring functions as a latch spring that, in combination with expander 248 and boss 238, allows the device of the invention to attain the several salient states referred to herein and illustrated in the Drawing.

Figure 8:
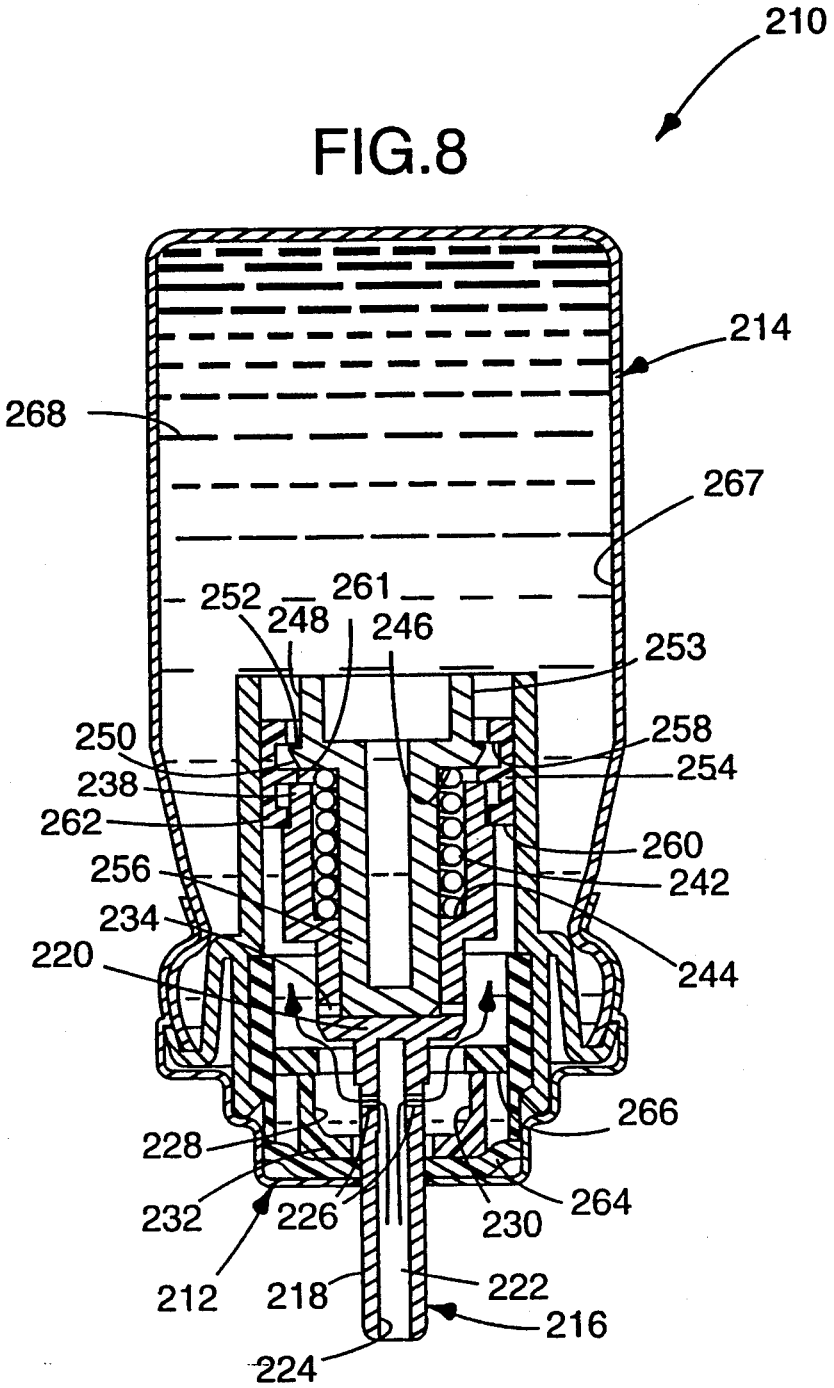

Referring now to FIG. 8, device 210 in the filling state is illustrated. Valve stem 216 is fully displaced inward relative to the valve ferrule. Boss 238 of the valve stem is engaged with stop 261 of expansion ring 254. Boss 238 has displaced expansion ring 254 along beveled edge 250 by engaging ledge 260 while the valve stem was depressed. Displacement along the beveled edge causes the expansion ring to expand to a diameter sufficient to allow boss 238 to slip inside the expansion ring and engage stop 261. Ledge 260, expansion ring 254, boss 238, and core 256 are dimensioned such that displacement of the valve stem allows hook 258 to be displaced beyond beveled edge 250 to region 253 of decreased diameter.

Diaphragm 264 is in sealing engagement with first portion 218 of the valve stem. Orifice 226 is internal to valve ferrule 212, allowing open communication between the interior and the exterior of the valve ferrule. Further, second portion 220 of the valve stem is displaced beyond annular seal 266, establishing open communication to formulation chamber 267 without displacing or deforming any seals or gaskets. Formulation 268 can be filled into the device through the valve stem using conventional pressure filling equipment.

Figure 9:
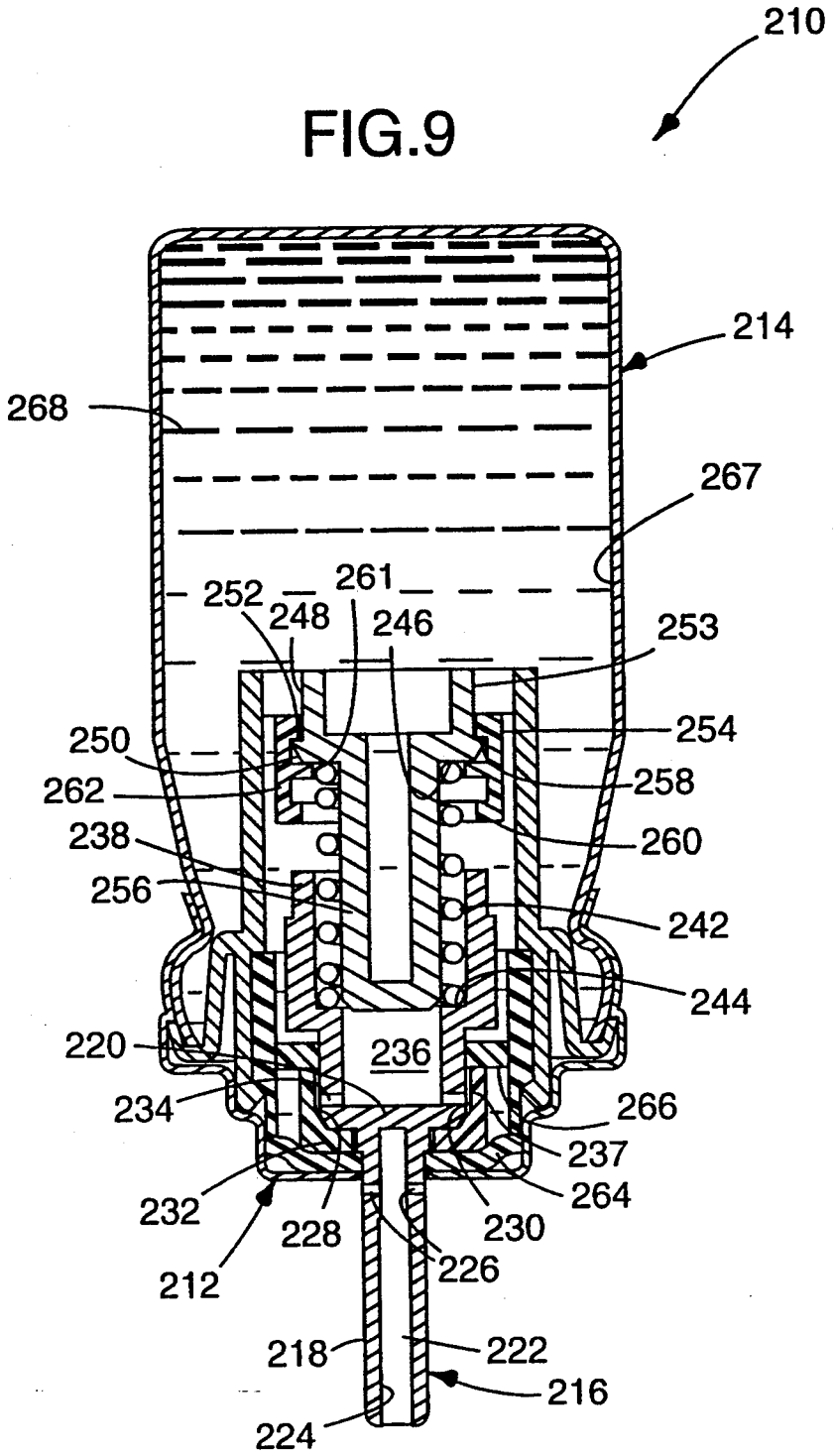

FIG. 9 shows device 210 in the filled state. Spring 242 biases valve stem 216 to an extended closed position wherein orifice 226 is external to valve ferrule 212.

Second portion 220 of the valve stem and assembly 232 are disposed as described above, closely complementary with gap 237 therebetween. Boss 238 has been extracted from the interior of expansion ring 254. Hook 258 is engaged with catch 252 and stop 261 is engaged with channel 246, holding expansion ring 254 in place. As described above in connection with device 10, the position and diameter of the expansion ring prevent the device from being placed again in the filling state. Operation of device 210 is substantially as described above and illustrated in connection with device 10.

Figure 10:
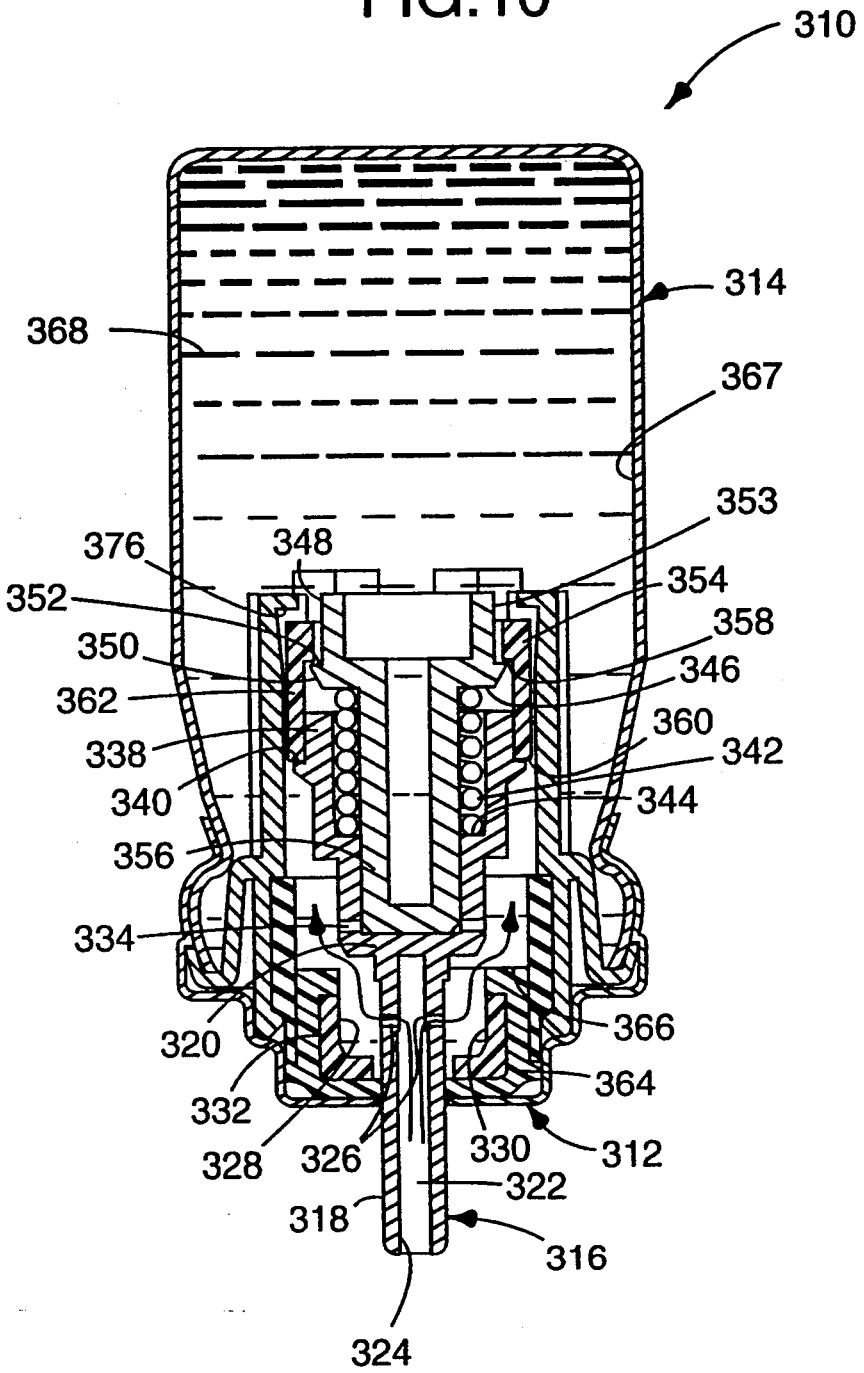
FIGS. 10–12 are cross sectional views of yet another embodiment of the invention.

In FIG. 10, a device 310 of the invention in the filling state is illustrated. Valve stem 316 is fully displaced inward relative to the valve ferrule. Stop 340 of the valve stem is engaged with butt 360 of expansion ring 354, which has been displaced by boss 338 along beveled edge 350. Displacement along the beveled edge causes the expansion ring to expand to a diameter sufficient to allow boss 338 to slip inside the expansion ring. Butt 360, expansion ring 354, boss 338, stop 340, and core 356 are dimensioned such that displacement of the valve stem allows hook 358 to be displaced beyond beveled edge 350 to region 353 of decreased diameter.

Diaphragm 364 is in sealing engagement with first portion 318 of the valve stem. Orifice 326 is internal to valve ferrule 312, allowing open communication between the interior and the exterior of the valve ferrule. Further, second portion 320 of the valve stem is displaced beyond annular seal 366, establishing open communication to formulation chamber 367 without displacing or deforming any seals or gaskets. Formulation 368 can be filled into the device through the valve stem using conventional pressure filling equipment.

Figure 11:
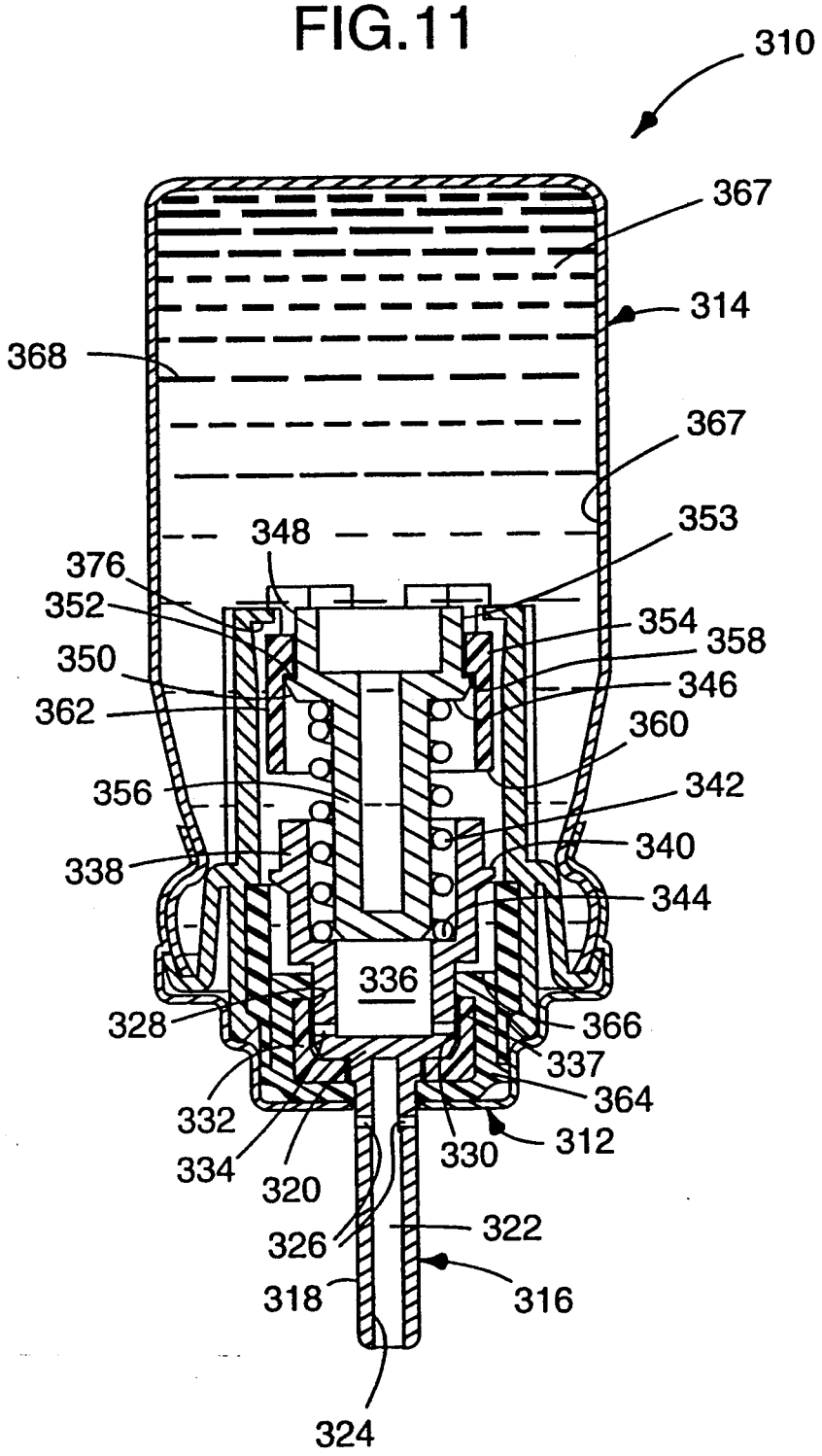

FIG. 11 shows device 310 of the invention in the filled state. Valve ferrule 312 is crimped onto aerosol vial body 314. Ferrule 312 houses certain of the components of the device, such as seals, gaskets, springs, and the like, and the several means described in detail below. Valve stem 316 is also housed by the valve ferrule. The valve stem has a first portion 318 generally exterior to the ferrule and a second portion 320 generally interior to the ferrule. First portion 318 has a diameter that is less than the diameter of second portion 320. Valve stem 316 also has discharge channel 322 defined by walls 324 of the first portion of the valve stem, and exit orifice 326 which communicates with discharge channel 322 of the valve stem. Exit orifice 326 is exterior to valve ferrule 312.

Second portion 320 of the valve stem comprises walls 328 that are of substantially the same configuration as adjacent walls 330 of assembly 332. Second portion 320 also has a passageway 334 that communicates with interior chamber 336. There exists an annular gap 337 between assembly 332 and the walls of the second portion of the valve stem. Gap 337 is of a size sufficient to allow the ingress of aerosol formulation. The second portion of the valve stem also comprises boss 338 and stop 340.

Device 310 further comprises spring 342 which biases valve stem 316 toward an extended closed position. Spring 342 engages the valve stem at shoulder 344 and it engages the valve ferrule at channel 346 of expander 348. Expander 348 comprises beveled edge 350 having an outside diameter that increases progressively along the axis of the expander in the direction away from channel 346. Beveled edge 350 terminates at catch 352 and the diameter of the expander decreases abruptly to form region 353 of decreased diameter.

Expansion ring 354 surrounds core 356 of the valve stem and comprises hook 358 generally complementary and proximal to catch 352, butt 360, and walls 362 spanning hook 358 and butt 360. Spring 342 biases valve stem 316 to an extended closed position wherein orifice 326 is external to valve ferrule 312. Second portion 320 of the valve stem and assembly 332 are disposed as described above, closely complementary with gap 337 therebetween. Boss 338 has been extracted from the interior of expansion ring 354 and hook 358 is engaged with catch 352, holding expansion ring 354 in place.

Figure 12:
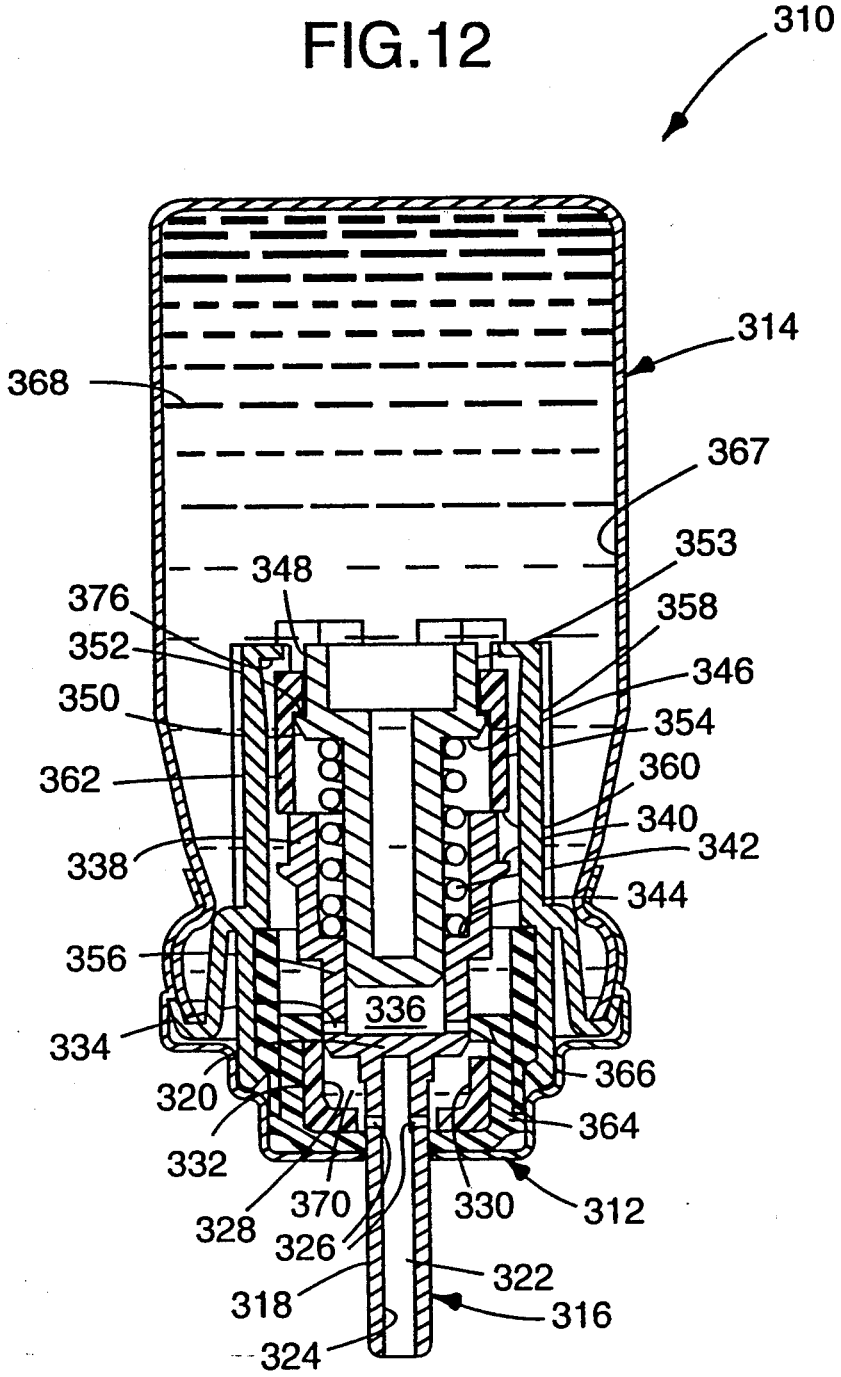

FIG. 12 shows device 310 in the dispensing state. Valve stem 316 is fully depressed against the bias of spring 342 to the point where boss 338 engages butt 360 of expansion ring 354. The valve stem cannot be further depressed, for the expansion ring is fixed in position by engagement with catch 352 and base 376. Annular seal 366 isolates the metering chamber from internal chamber 336 and formulation chamber 367. Orifice 326, however, is internal to valve ferrule 312 and communicates with metering chamber 370, allowing the contents of the metering chamber to escape via the orifice and discharge channel 322.

In the illustrated embodiment the expansion ring can be made of any resilient plastic (e.g., Delrin TM acetal resin) or metal. The spring is preferably made of stainless steel. The valve stem is preferably made of Delrin TM acetal resin but can also be stainless steel. Appropriate materials of construction of the device of the invention can be readily selected by those skilled in the art with due consideration of the formulation to be dispensed from the device, the need for effective sealing means to contain the formulation that is intended to be filled into the device, the need for proper biasing of the valve stem and proper resiliency of the expansion ring, and the particular actuator to be used in combination with the device.

I claim:

1. A device for delivering a metered dose of an aerosol formulation, comprising:

a valve ferrule; a formulation chamber; and a valve stem mounted within the valve ferrule and having a first portion having a first diameter and a second portion having a greater diameter than the first diameter, the valve stem having walls defining a valve stem orifice and being movable from a first filling state to a second filled state, between said second filled state and a third metering state, and between said third metering state and a fourth dispensing state;

wherein in the first filling state at least part of the first portion of the valve stem is internal to the valve ferrule, and the formulation chamber and the exterior of the device are in open communication, in the second filled state at least part of the first portion of the valve stem is external to the valve ferrule and the second portion of the valve stem is internal to the valve ferrule, in the third metering state at least part of the first portion of the valve stem is internal to the valve ferrule forming a metering chamber defined by displacement of the valve stem within the valve ferrule, and the metering chamber communicates with the formulation chambers has been inserted after the second occurrence of "chamber", in the fourth dispensing state at least part of the first portion of the valve stem is internal to the valve ferrule and the metering chamber is sealed from the formulation chamber and communicates with the exterior of the device via the valve stem orifice, the device further comprising means comprising an expander and a latch spring for preventing return of the device to the first filling state once it has been placed in the second filled state, wherein the expander comprises a beveled edge having an outside diameter that increases progressively along the axis of the expander and decreases abruptly to form a catch in a region of decreased diameter.

2. A device according to claim 1, wherein the latch spring comprises an expansion ring comprising a hook generally complementary and proximal to the catch, a ledge, and walls spanning the hook and the ledge, wherein the hook and the ledge extend radially inward from the walls.

3. A device according to claim 1 in combination with an actuator comprising a housing adapted to receive and support the device.

4. A method of delivering a metered dose of an aerosol formulation from a device comprising a valve ferrule; a formulation chamber; and a valve stem mounted within the valve ferrule and being movable from a first filling state to a second filled state, between said second filled state and a third metering state, and between said third metering state and a fourth dispensing state; comprising the steps of:

establishing open communication between the exterior of the device and the formulation chamber when the device is in the first filling state;

effecting a mechanism comprising an expander and a latch spring that prevents return of the device to the first filling state from the second filled state;

forming a metering chamber having a predetermined volume when the device is in the third metering state;

supplying formulation to said metering chamber from the formulation chamber as such chamber is being formed; and establishing open communication via the valve stem between the metering chamber and the exterior of the device when the device is in the fourth dispensing state.

* * * * *

UNITED STATES PATENT AND TRADEMARK OFFICE

CERTIFICATE OF CORRECTION

PATENT NO.: 5,400,920

DATED: March 28, 1995

INVENTOR(S): James B. Barnhart

It is certified that error appears in the above-identified patent and that said Letters Patent is hereby corrected as shown below:

Col. 8, lines 64-65, "chambers has been inserted after the second occurrence of "chamber"," should read --chamber via a passageway in the valve stem,--.

Signed and Sealed this

Fifth Day of November, 1996

Bruce Lehman

*Attest:*

BRUCE LEHMAN

*Attesting Officer*

*Commissioner of Patents and Trademarks*